US011260665B2

(12) United States Patent
Jariabka et al.

(10) Patent No.: US 11,260,665 B2
(45) Date of Patent: Mar. 1, 2022

(54) PRINT HEAD LOCK

(71) Applicant: Hewlett-Packard Development Company, L.P., Spring, TX (US)

(72) Inventors: Keith Jariabka, Vancouver, WA (US); Jafar N Jefferson, Vancouver, WA (US); William Fournier, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/771,378

(22) PCT Filed: Dec. 14, 2017

(86) PCT No.: PCT/US2017/066461
§ 371 (c)(1),
(2) Date: Jun. 10, 2020

(87) PCT Pub. No.: WO2019/117924
PCT Pub. Date: Jun. 20, 2019

(65) Prior Publication Data

US 2021/0170750 A1 Jun. 10, 2021

(51) Int. Cl.

| | |
|---|---|
| ***B41J 2/165*** | (2006.01) |
| ***B41J 29/02*** | (2006.01) |
| ***B41J 29/13*** | (2006.01) |
| ***B41J 29/38*** | (2006.01) |
| ***B41J 29/58*** | (2006.01) |

(52) U.S. Cl.
CPC ..... *B41J 2/16511* (2013.01); *B41J 29/02* (2013.01); *B41J 29/13* (2013.01); *B41J 29/38* (2013.01); *B41J 29/58* (2013.01)

(58) Field of Classification Search
CPC ..... B41J 2/16511
See application file for complete search history.

(56) References Cited

U.S. PATENT DOCUMENTS

| | | | | |
|---|---|---|---|---|
| 4,177,471 | A | 12/1979 | Mitchell | |
| 5,898,444 | A | 4/1999 | Kobayashi et al. | |
| 6,132,027 | A | 10/2000 | Suzuki et al. | |
| 6,328,492 | B1 * | 12/2001 | McKay | B41J 2/16511 347/29 |
| 6,334,663 | B1 | 1/2002 | Lee | |
| 6,588,876 | B2 | 7/2003 | Taylor et al. | |
| 9,346,638 | B2 | 5/2016 | Jariabka | |
| 2003/0222939 | A1 | 12/2003 | Gompertz | |

(Continued)

FOREIGN PATENT DOCUMENTS

| | | |
|---|---|---|
| CN | 1338382 | 3/2002 |
| CN | 1088653 | 8/2002 |

(Continued)

*Primary Examiner* — Jason S Uhlenhake
(74) *Attorney, Agent, or Firm* — HP Inc. Patent Department

(57) ABSTRACT

An example apparatus includes a gear comprising a gear hub; a swing-arm rotationally engaged with the gear hub; and a spring circumferentially engaged with the gear hub and the swing-arm to apply a radial clamping force between the swing-arm and the gear hub. Torque is frictionally coupled from the gear hub to the swing-arm to lock a capped print head assembly (PHA) in a non-printing location.

14 Claims, 9 Drawing Sheets

(56) References Cited

U.S. PATENT DOCUMENTS

| | | | | |
|---|---|---|---|---|
| 2007/0046721 | A1* | 3/2007 | Miyazawa | B41J 2/16532 347/29 |
| 2008/0198197 | A1 | 8/2008 | Morris | |
| 2009/0122107 | A1 | 5/2009 | Ray | |
| 2011/0279520 | A1 | 11/2011 | Love | |

FOREIGN PATENT DOCUMENTS

| | | |
|---|---|---|
| CN | 103442897 | 12/2013 |
| EP | 0850773 | 7/1998 |
| EP | 0913264 | 5/1999 |
| EP | 1142716 | 10/2001 |
| JP | 2006130666 | 5/2006 |
| JP | 2006159595 | 6/2006 |
| JP | 459997 | 12/2010 |
| WO | WO-2017127087 A1 | 7/2017 |

* cited by examiner (Detail A from
Figure 12)

(Detail B from
Figure 14)

PRINT HEAD LOCK

BACKGROUND

Printers are commonplace, whether in a home environment or an office environment. Such printers can include laser printer, inkjet printers or other types. Generally, printers include print heads which deposit ink onto a print medium, such as paper. The print heads may move across, for example, the width of the print medium to selectively deposit ink to produce the desired image. Inkjet printers create images from digital files by propelling droplets of ink onto paper or other materials. The droplets are deposited from nozzles in a print head assembly as the print head assembly traverses a print carriage as the paper is advanced. Inkjet printers typically, include a service station to maintain the health of the print head assembly.

BRIEF DESCRIPTION OF THE DRAWINGS

For a more complete understanding of various examples, reference is now made to the following description taken in connection with the accompanying drawings in which.

DETAILED DESCRIPTION

Nozzles in the print heads of inkjet printers may be operated after extended periods of non-operation. During periods of non-operation, various factors, such as humidity and/or pressure, may result in clogging of the nozzles and changes in the chemistry of the ink in the ink delivery system.

In normal operation, when the printer is in a fixed location, the mechanical forces experienced by the print head assembly and the service station are insufficient to dislodge the service station from the print head assembly. However, if the printer is moved, it may be subjected to mechanical shocks or tilting during transport that could disengage the service station from the print head assembly, exposing the nozzles to an uncontrolled environment.

In various examples, a controlled environment may be provided by capping the nozzles at a service station when the printer is in a non-printing mode. To ensure the integrity of the controlled environment of capped nozzles of a print head assembly in response to mechanical shocks and physical transport, various examples provide for both capping and locking a print head assembly in an inkjet printer. The capping is achieved by automatically engaging the print head assembly (PHA) with a cap sled assembly when the PHA is moved to a non-printing location in the printer. When the PHA and the cap sled assembly are engaged, a swing-arm attached to a gear is rotated to engage a hook in the cap sled assembly, which locks the cap sled assembly and the PHA in place. The swing-arm is frictionally coupled to a hub of the gear with a spring-based clamping arrangement. Accordingly, the present disclosure describes example apparatus, methods and non-transitory computer-readable storage media for capping and locking print head assemblies in inkjet printers.

Figure 1:
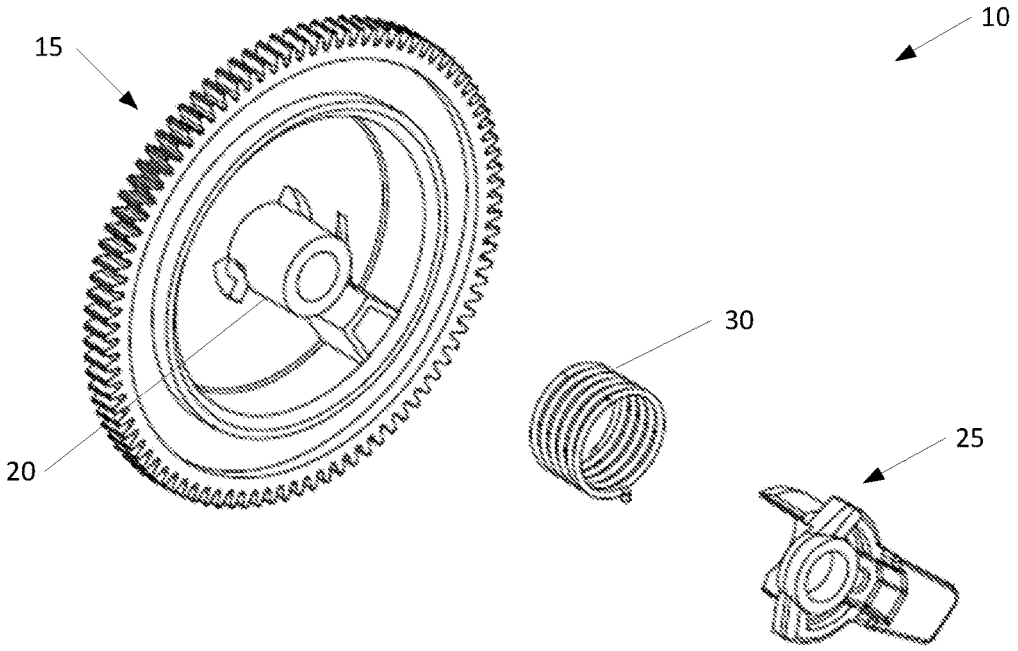
FIG. 1 illustrates an example apparatus.

Turning now to the figures, FIG. 1 illustrates an example apparatus. FIG. 1 is an exploded view of an example gear and swing-arm assembly. The example assembly 10 includes a gear 15 with a gear hub 20, a swing-arm 25 that is rotationally engaged with the gear hub, and a compressive member 30 (e.g., a coil spring). In various examples, the swing arm 25 fits over the gear hub 20. The compressive member 30 is circumferentially engaged with the gear hub and the swing arm to apply a radial clamping force between the gear hub 20 and the swing-arm 25. A torque is frictionally coupled from the gear hub to the swing-arm to lock a capped PHA in a non-printing location. In various examples, when the PHA is unlocked for normal printing operations, the range of rotation of the swing-arm is limited by mechanical stops. This arrangement allows the gear, which is part of the printer's paper handling system, to rotate independently of the swing-arm. Further examples of gear and swing-arm assemblies are described in greater detail below.

Figure 2:
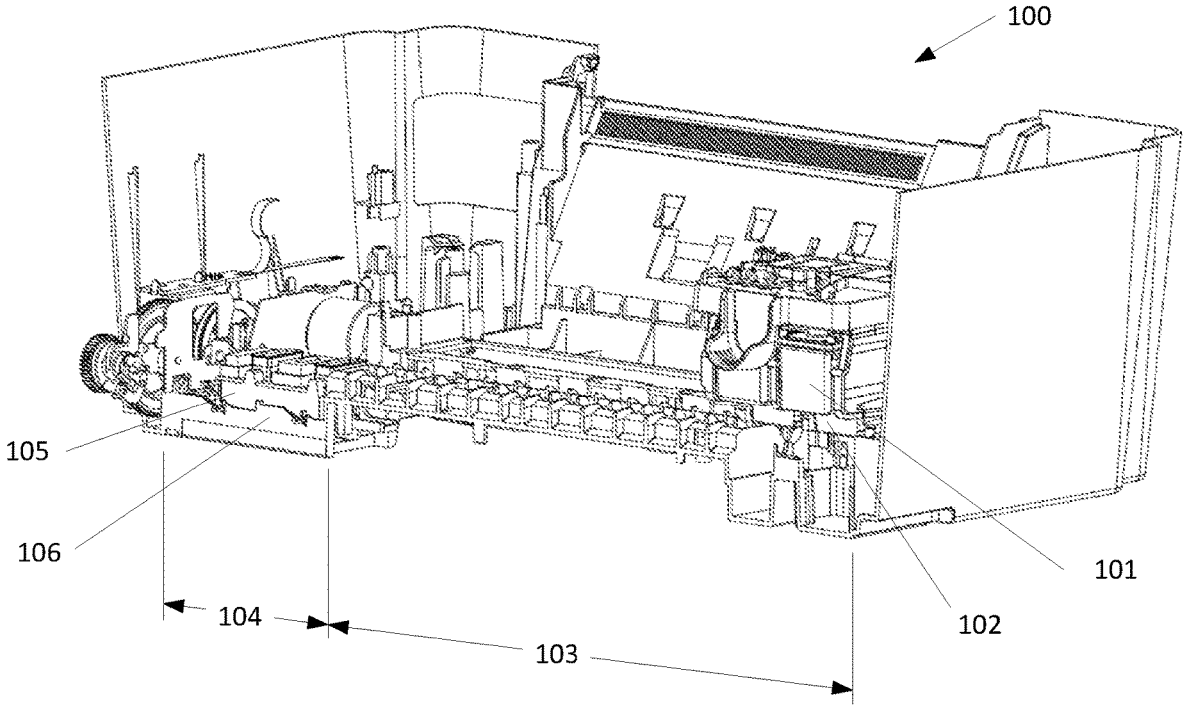
FIG. 2 is a cutaway view of an example printer assembly.

FIG. 2 illustrates a cutaway view of an example printer assembly 100, which includes a carriage assembly comprising a print head assembly (PHA) 101, a carriage 102 to transport the PHA 101 side-to-side in a printing zone 103. The example printer assembly also includes a service station assembly, located in a non-printing zone 104, comprising a cap sled assembly 105 and a cap sled ramp 106. In the configuration illustrated in FIG. 2, the PHA 101 is shown at the far right of the printer's printing zone 103, and the cap sled assembly 105 is located above the cap sled ramp 106 in the non-printing zone 104. As described above, PHA 101 may be maintained in a controlled environment when it is not printing, so after a print job is completed, the PHA 101 is translated to the location of the cap sled assembly 105 where the PHA 101 engages the cap sled assembly 105. The engagement occurs in several steps, as illustrated in FIGS. 2 through 5.

Figure 3:
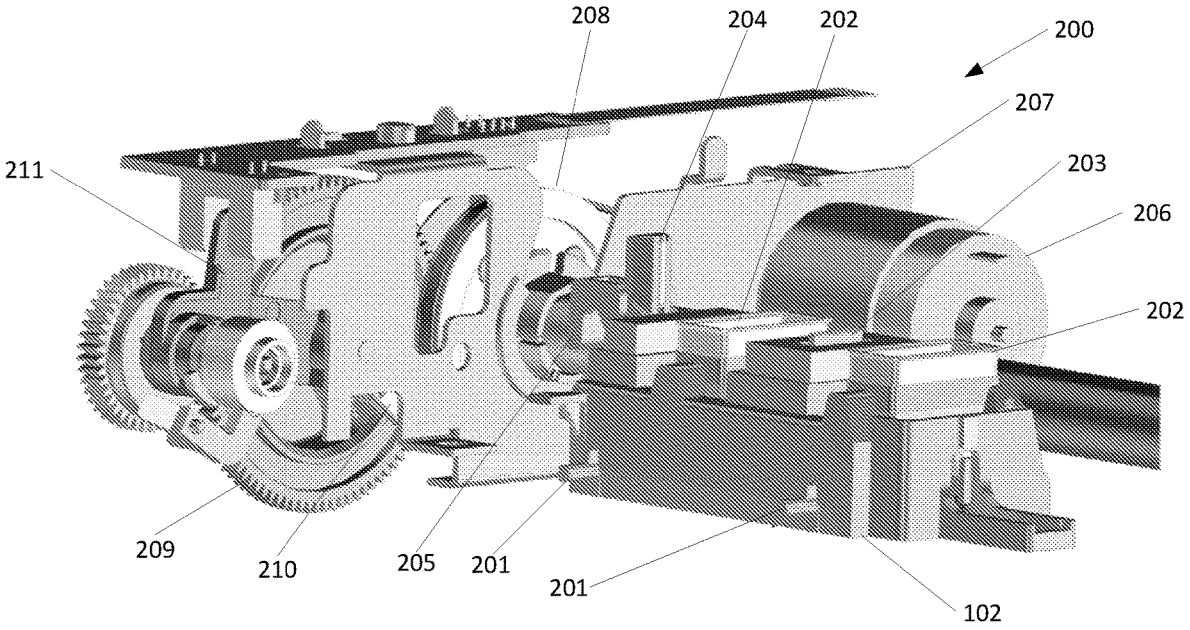
FIG. 3 is a perspective view of a portion of the example printer assembly of FIG. 2.

FIG. 3 is a perspective view of an isolated portion 200 of the example printer assembly 100. Illustrated in FIG. 3 is an example cap sled assembly 105 in its "home" position when not engaged with the PHA 101. As described in greater detail below, the cap sled assembly 105 has a limited range of motion, both horizontally and vertically, constrained by the cap sled ramp 106 (not shown in FIG. 3). This motion is controlled by the engagement of pins 201 of the cap sled assembly 105 with the cap sled ramp 106. In FIG. 3, there are two pins 201 illustrated. In some examples, there may also be two additional pins on the opposite (hidden) side of the cap sled assembly 105.

Example cap sled assembly 105 also includes two caps 202, which are used to cap the nozzles of the PHA 101 when the cap sled assembly 105 and the PHA 101 are engaged. In some examples, the caps 202 may be fabricated from an elastomeric material to provide a compression seal to the nozzles of the PHA 101. In other examples, the caps 202 may be partially ventilated to maintain a proper pressure and/or humidity environment for the nozzles of the PHA 101. In other examples, cap sled assembly 105 may include fewer or greater than two caps 202. Also shown in FIG. 3 is a vane 203, a post 204, and a hook 205, which are described in detail below.

Also illustrated in FIG. 3 are other example components relevant to the present disclosure. These components include a motor 206, a support bracket 207, a driven gear 208, an idler gear 209, a swing-arm 210 coupled with the idler gear 209 (partially hidden by support bracket 207), and a hinge 211. These components are also described in greater detail below.

Figure 4:
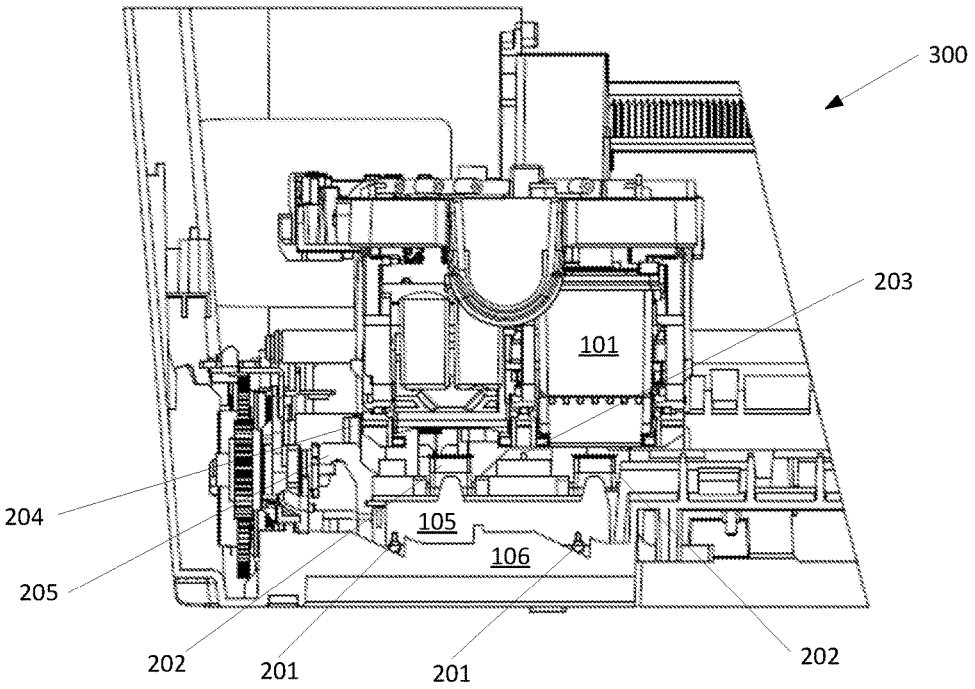
FIG. 4 is a plane view of a printer assembly illustrating an initial engagement of an example print head assembly with an example cap sled assembly.

Referring now to FIG. 4, there is illustrated a partial cutaway plane view of an example printer assembly 300, where the PHA 101 has been translated from the printing zone 103 to the non-printing zone 104, and has just made contact with the post 204 of the cap sled assembly 105. Also illustrated in FIG. 4 are the caps 202, the vane 203, and the hook 205. It will be appreciated that the PHA 101 may be translated horizontally by any convenient means known in the art. In one example, without limitation, the horizontal movement of the PHA 101 may be achieved using a motor-driven belt (not shown).

In the configuration illustrated in FIG. 4, the cap sled assembly 105 is in its rightmost position, and the pins 201 are seated at the bottoms of the ramps of the cap sled ramp 106. In this position, the PHA 101 is horizontally aligned with the cap sled assembly 105, but separated vertically from the cap sled assembly 105. In one example, this position of the cap sled assembly 105 is a default or "return to" position when the cap sled assembly 105 is not engaged with the PHA 101. In one example, and without limitation, the cap sled assembly 105 may be biased to the default position by a spring coupling to the cap sled ramp 106 or a fixed component of the printer assembly 300.

Figure 5:
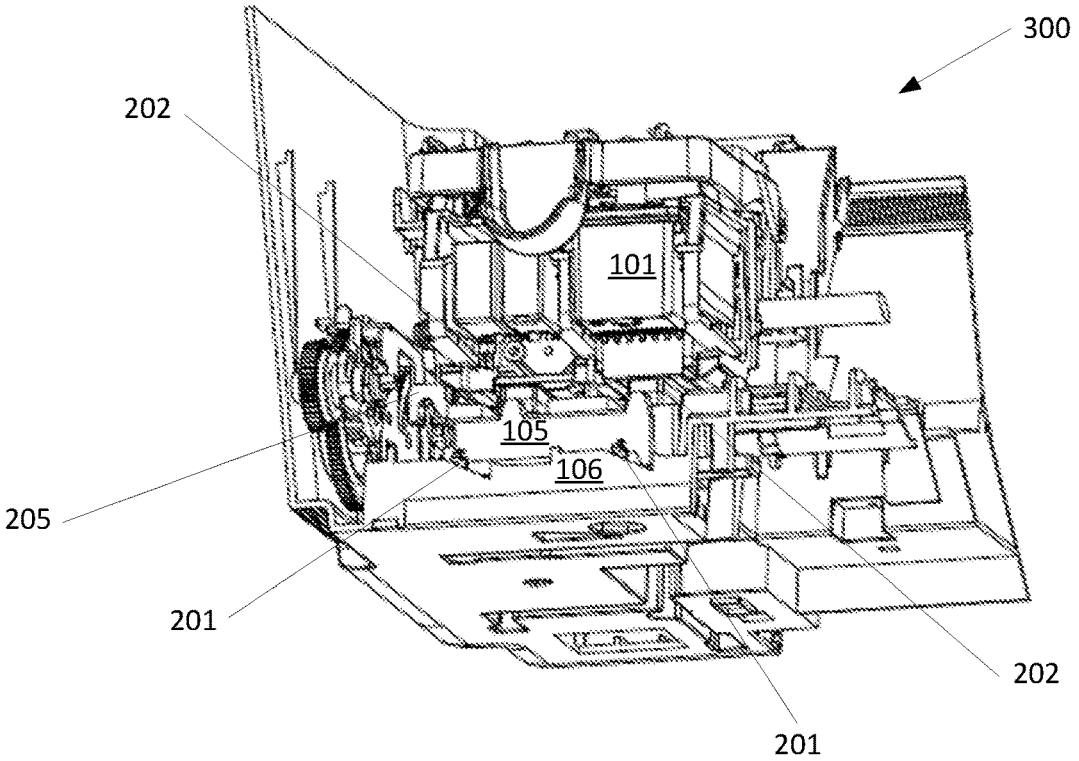
FIG. 5 is a perspective view illustrating a further translation of an example print head assembly and engagement with an example cap sled assembly.

FIG. 5 is a perspective view of an isolated portion of the example printer assembly 300. FIG. 5 illustrates the PHA 101 translated further to the left while engaged with the cap sled assembly 105 via contact with the post 204, causing the cap sled assembly to move to the left in synchrony with the PHA 101. As the cap sled assembly 105 moves to the left, the pins 201 of the cap sled assembly 105 are moved to the left and up the ramps of the cap sled ramp 106. As a result, the cap sled assembly 105 moves vertically, as well as horizontally, to close the separation between the PHA 101 and the cap sled assembly 105.

Figure 6:
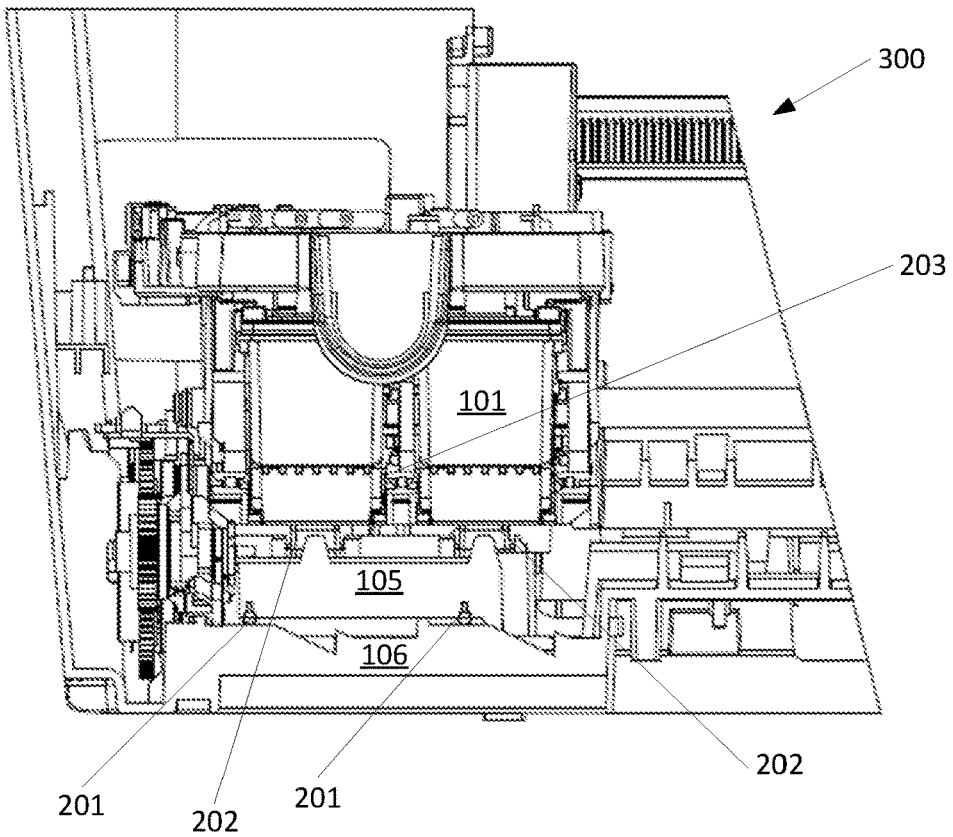
FIG. 6 is a plane view illustrating the translation of the print head assembly and the cap sled assembly to their leftmost position.

FIG. 6 is a plane view of the example printer assembly 300, illustrating the carriage assembly containing the PHA 101 translated to its leftmost position, fully engaged with the cap sled assembly 105. In this position, the pins 201 of the cap sled assembly 105 have cleared the ramps of cap sled ramp 106, resting on the flat surface of cap sled ramp 106. In this configuration, the caps 202 of the cap sled assembly 105 are compressed over the nozzles of the PHA 101, and the vane 203 of the cap sled assembly has engaged a corresponding slot in the PHA 101 to prevent any relative horizontal movement between the PHA 101 and the cap sled assembly 105 that might degrade or damage the seals provided by the caps 202. It will be appreciated that, absent additional precautions, this configuration might be disturbed by some shock to the printer carriage or by gravity if the printer carriage is rotated during transport, or by the force of the spring coupling of the cap sled assembly described above. Such movement could force the coupled PHA 101 and cap sled assembly 105 to the right, which could uncap the nozzles of the PHA 101. To prevent such an occurrence, in one example, a positive locking mechanism may be implemented as described below.

Figure 7:
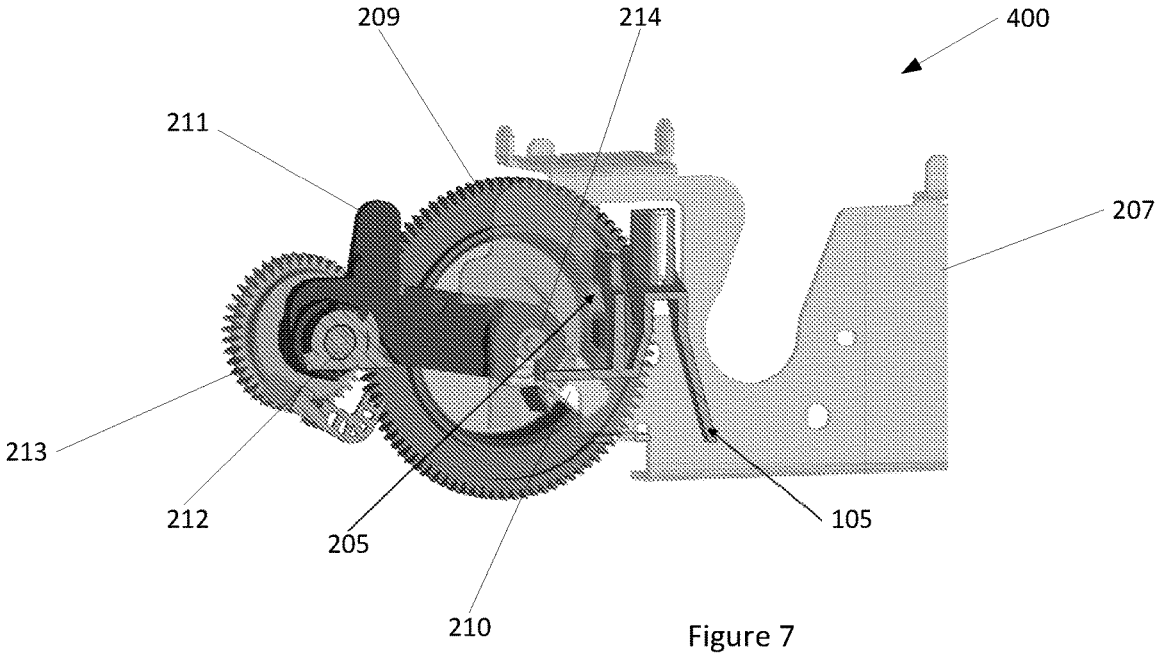
FIG. 7 is a cutaway perspective view corresponding to FIG. 6, illustrating the alignment of a locking arm with a hook in the cap sled assembly.

FIG. 7 is a cutaway perspective view of an isolated portion 400 of the example printer assembly 100, similar to FIG. 3, but with the cap sled assembly in its leftmost location corresponding to FIG. 6. Illustrated in FIG. 7 are the support bracket 207 (shown as semi-transparent in FIG. 7 for purposes of clarity), the cap sled assembly 105 (mostly cut away), the hook 205 on the cap sled assembly 105, the idler gear 209, the swing arm 210, and the hinge 211. In one example, the hinge 211 is attached at one end to an output shaft 212, driven by an output gear 213 that is in turn driven by the idler gear 209. The other end of the hinge 211 is supported by a pin 214 in the support bracket 207 around which it rotates. Pin 214 also supports the idler gear 209 such that the hinge 211 and the idler gear 209 have the same center of rotation.

Notably, in the configuration illustrated in FIG. 7, the hook 205 on the cap sled assembly 105 is aligned with the swing-arm 210, which allows the swing-arm 210 to be rotated (counter-clockwise in the view provided by FIG. 7) to engage the hook 205 on the cap sled assembly 105, when the hook 205 is in the proper position for engagement with the swing-arm 219. This position may be detected in many ways. In one example, a position encoder may be used to report the position of the PHA 101 (corresponding to the position of the cap sled assembly 105) to a controller which controls the motor 206 (see FIG. 3) and the rotation of the idler gear 209 and the swing-arm 210. In other examples, and without limitation, the position may be detected by the closure of an electrical contact or a mechanical switch when the cap sled assembly 105 reaches its final position.

Figure 8:
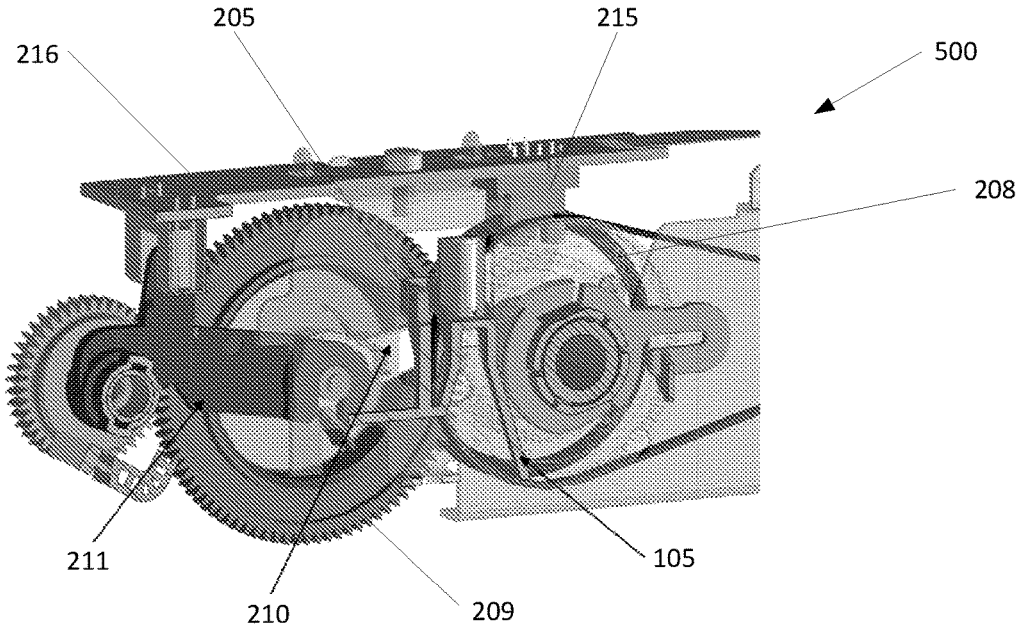
FIG. 8 is a cutaway perspective view corresponding with FIG. 7, but illustrating the swing-arm in a locked position.

FIG. 8 is another cutaway perspective view of an isolated portion 500 of the example printer assembly 100, similar to FIG. 7, but illustrating the swing-arm 210 in the locked position, engaged with the hook 205 of the cap sled assembly. In the view of FIG. 8, the idler gear 209 has been rotated counter-clockwise by action of the motor 203 (see FIG. 3) and the driven gear 208. In one example, the rotation may be detected by a rotary encoder 215 attached to a top bracket 216, which reads an encoded disk on the driven gear 208. In one example, described in greater detail below, the angular position of the driven gear 208 may be sent to a motor controller in a feedback loop to control motor 203. It will be appreciated that the gear trains illustrated in FIGS. 2, 6 and 7 are exemplary and not limiting. For example, idler gear 209 may be any type of directly or indirectly driven gear.

We turn now to a detailed description of the structure and functions of the idler gear 209, the swing-arm 210, and the hinge 211, illustrated in FIGS. 8 through 14.

Figure 9:
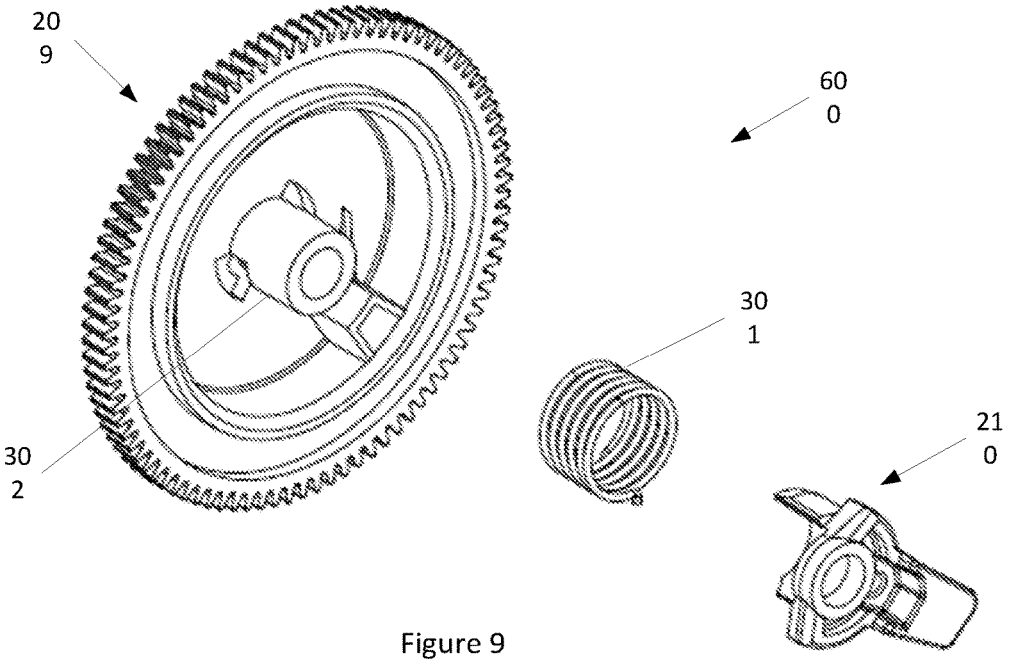
FIG. 9 is an exploded view of an example gear and swing-arm assembly, including a compressive member that couples the gear to the swing-arm assembly.

FIG. 9 is an exploded view of an example idler gear and swing-arm assembly 600, which includes the example idler gear 209, the example swing-arm 210 and an example coil spring 301, which is used to couple the swing-arm 210 to the idler gear 209 as described below.

Figure 10:
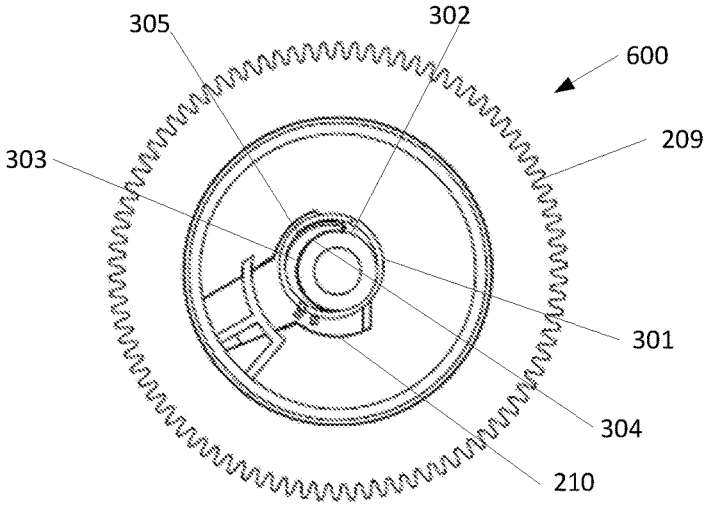
FIG. 10 is a plane view of an example gear and swing-arm assembly.

FIG. 10 is a plane view of the example idler gear and swing-arm assembly 600. As illustrated in FIG. 10, the swing-arm includes an arced segment 303 that has an inner circular arc segment 304 and an outer circular arc segment 305. The inner arc segment 304 is concentric with the outer diameter of the gear hub 302, and the outer arc segment 305 is concentric with the inner diameter of the coil spring 301, but eccentric with the outer diameter of the gear hub 302. The inner diameter of the coil spring 301 is less than the combined outer diameter of the gear hub 302 and the outer circular arc segment 305, so it must be expanded (i.e., unwound) to circumferentially engage the gear hub 302 and the swing-arm 210. As a result, the coil spring 301 applies a radial clamping force between the swing-arm 210 and the gear hub 302. This clamping force keeps the swing-arm 210 in rotational engagement with the gear hub 302 while providing a frictional torque coupling between the gear hub 302 and the swing-arm 210. In some examples, any other radially compressive member may be used in place of the coil spring 301. For example, and without limitation, the radially compressive element may be one or more elastic bands or rings.

Figure 11:
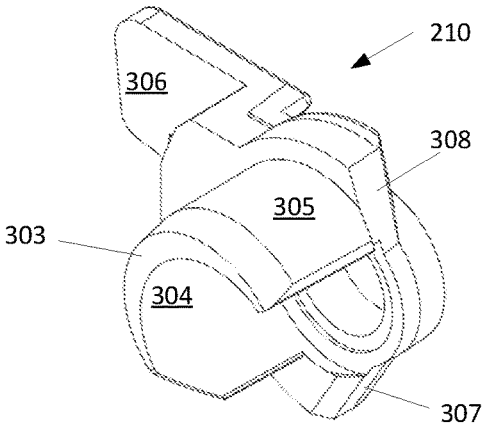
FIG. 11 is a perspective view of an example swing-arm.

FIG. 11 is a perspective view of the example swing-arm 210 to illustrate details of the swing-arm 210 with greater clarity. Illustrated in FIG. 11 are the arced segment 303 with its inner circular arc segment 304 and its outer circular arc segment 305. Also illustrated in FIG. 11 as part of the swing-arm 210, is a locking arm 306. Locking arm 306 is that portion of swing-arm 210 that engages the hook 205 in the cap sled assembly 105, as previously described. Example swing-arm 210 also includes facets 307 and 308 that may be used to provide limits on the rotation of the swing-arm 210. The facets 307 and 308 are flat surfaces on the swing-arm 210 that may engage matching stops on the hinge 211 as described in greater detail below.

Figure 12:
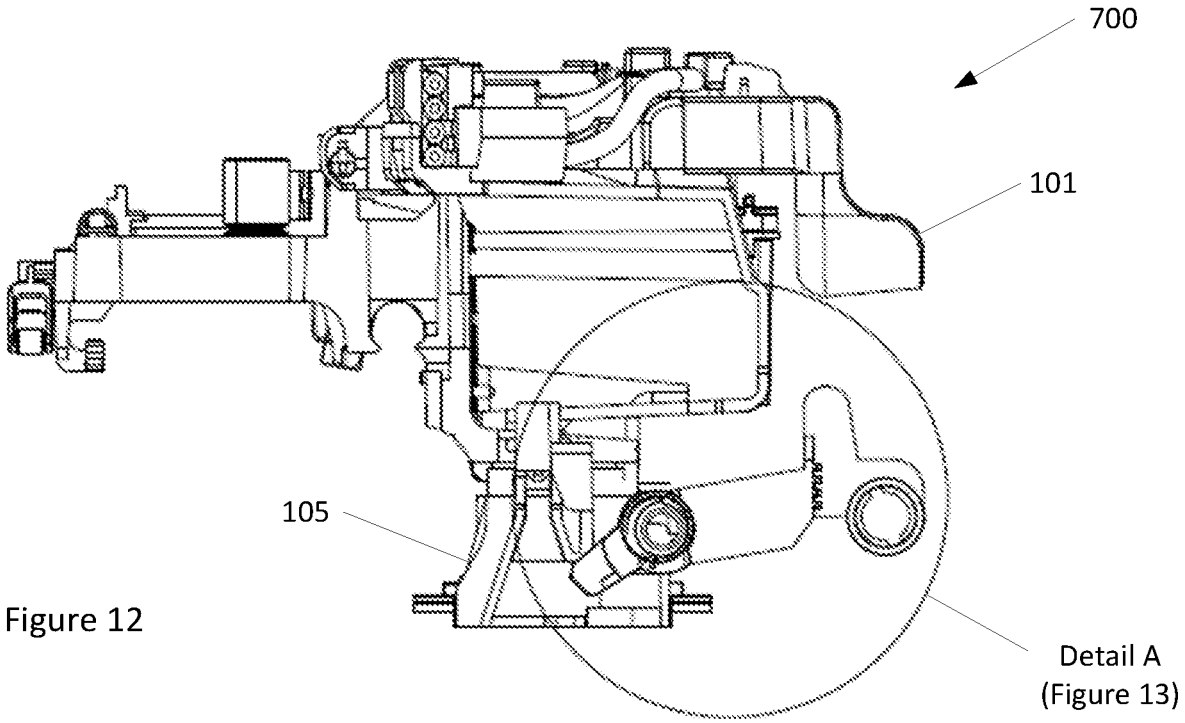
FIG. 12 is a side view of an example print head assembly engaged with an example cap sled assembly.
Figure 13:
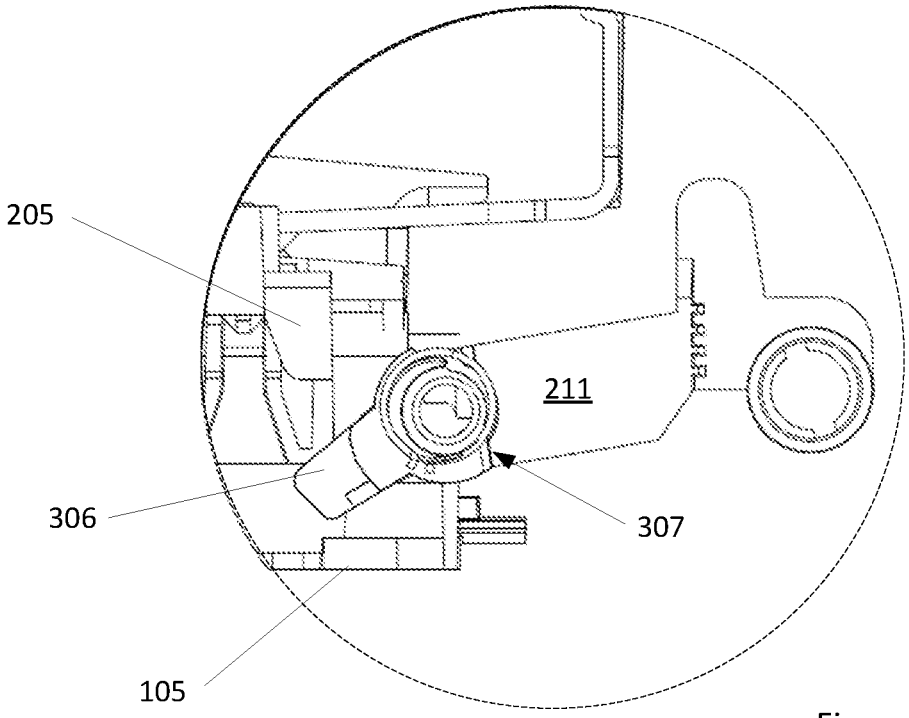
FIG. 13 is an enlarged view of Detail A of FIG. 12.

Turning now to FIG. 12, there is illustrated a left-side view 700 of the PHA 101 fully engaged with the cap sled assembly 105 in their non-printing position before the locking arm 306 engages the hook 205 on the cap sled assembly 105. For clarity, idler gear 209 has been deleted from this view. FIG. 13 is an enlarged view of Detail A from FIG. 12 illustrating the interface between the swing-arm 210 and the hinge 211. In the view provided by FIG. 13, the swing-arm 210 (and locking arm 306) have been rotated counter-clockwise by the frictional torque coupling between the swing-arm 210 and the gear hub 302 of the idler gear 209. As illustrated in FIG. 13, the rotation of the swing-arm 210 is limited by interference of the facet 307 of the swing-arm 210 with a corresponding facet of the hinge 211. This allows the idler gear to continue its counter-clockwise rotation (e.g., as part of a paper handling or paper output function) without further rotation of the swing-arm.

Figure 14:
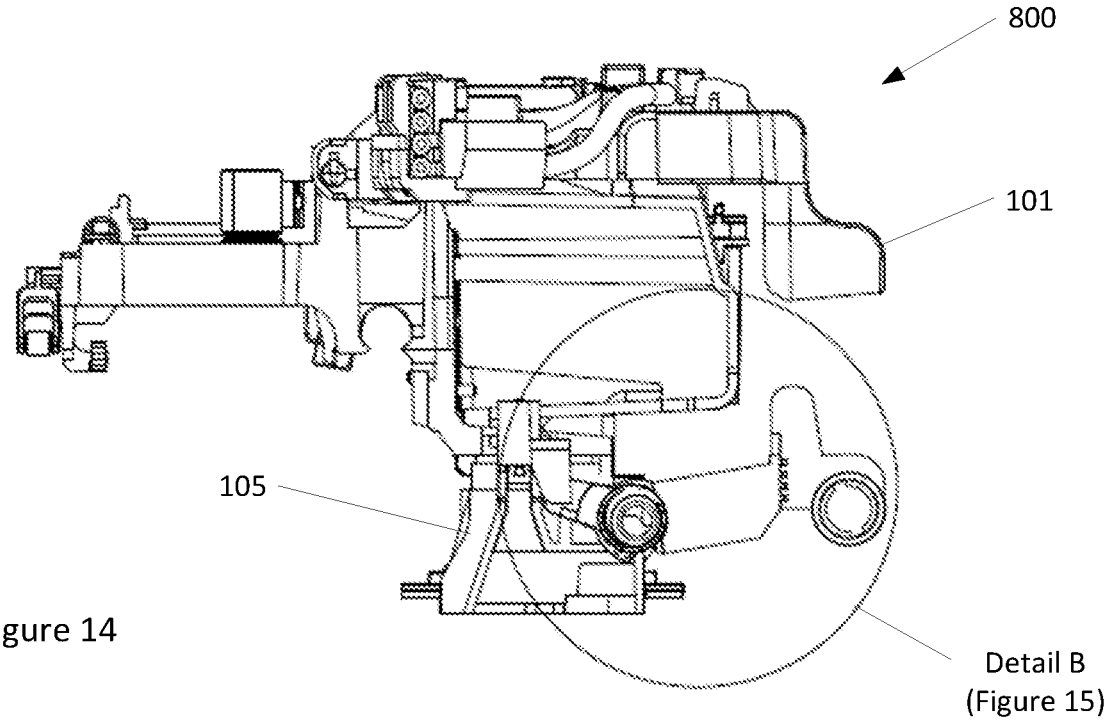
FIG. 14 is a side view of an example print head assembly engaged with an example cap sled assembly.
Figure 15:
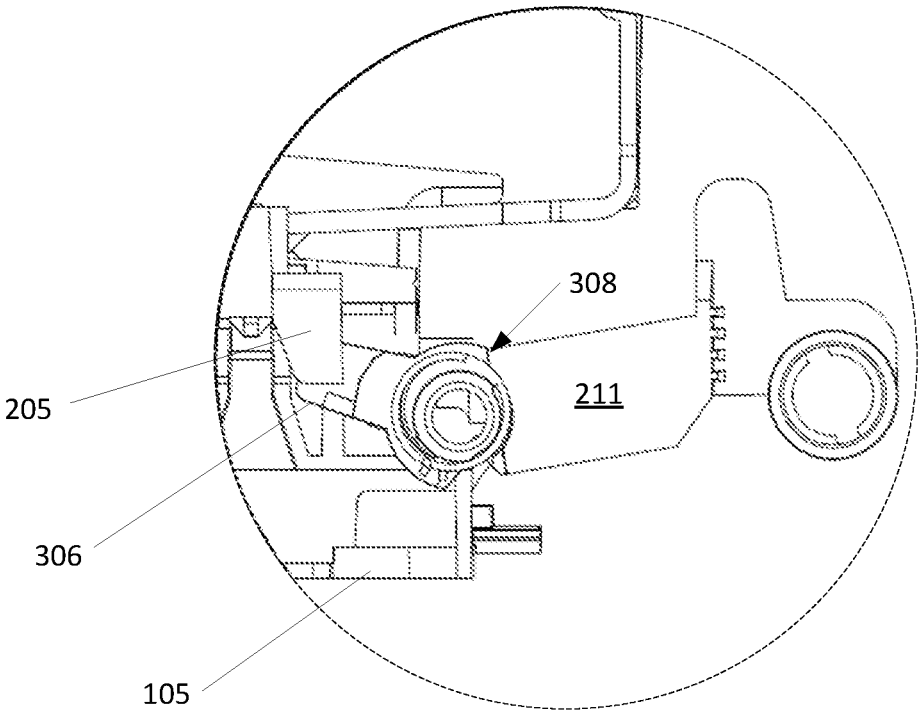
FIG. 15 is an enlarged view of Detail B of FIG. 14.

FIG. 14 is a left-side view 800, similar to FIG. 12, except that the locking arm 306 has been rotated clockwise to engage the hook 205 on the cap sled assembly. Again, idler gear 209 has been deleted from this view for clarity. FIG. 15 is an enlarged view of Detail B from FIG. 14 illustrating the interface between the swing-arm 210 and the hinge 211. In the view provided by FIG. 15, the swing-arm 210 (and locking arm 306) have been rotated clockwise by the frictional torque coupling between the swing-arm 210 and the gear hub 302 of the idler gear 209. As illustrated in FIG. 15, the rotation of the swing-arm 210 is limited by interference of the facet 308 of the swing-arm 210 with a corresponding facet of the hinge 211. This allows the idler gear to continue its clockwise rotation without further rotation of the swing-arm.

Figure 16:
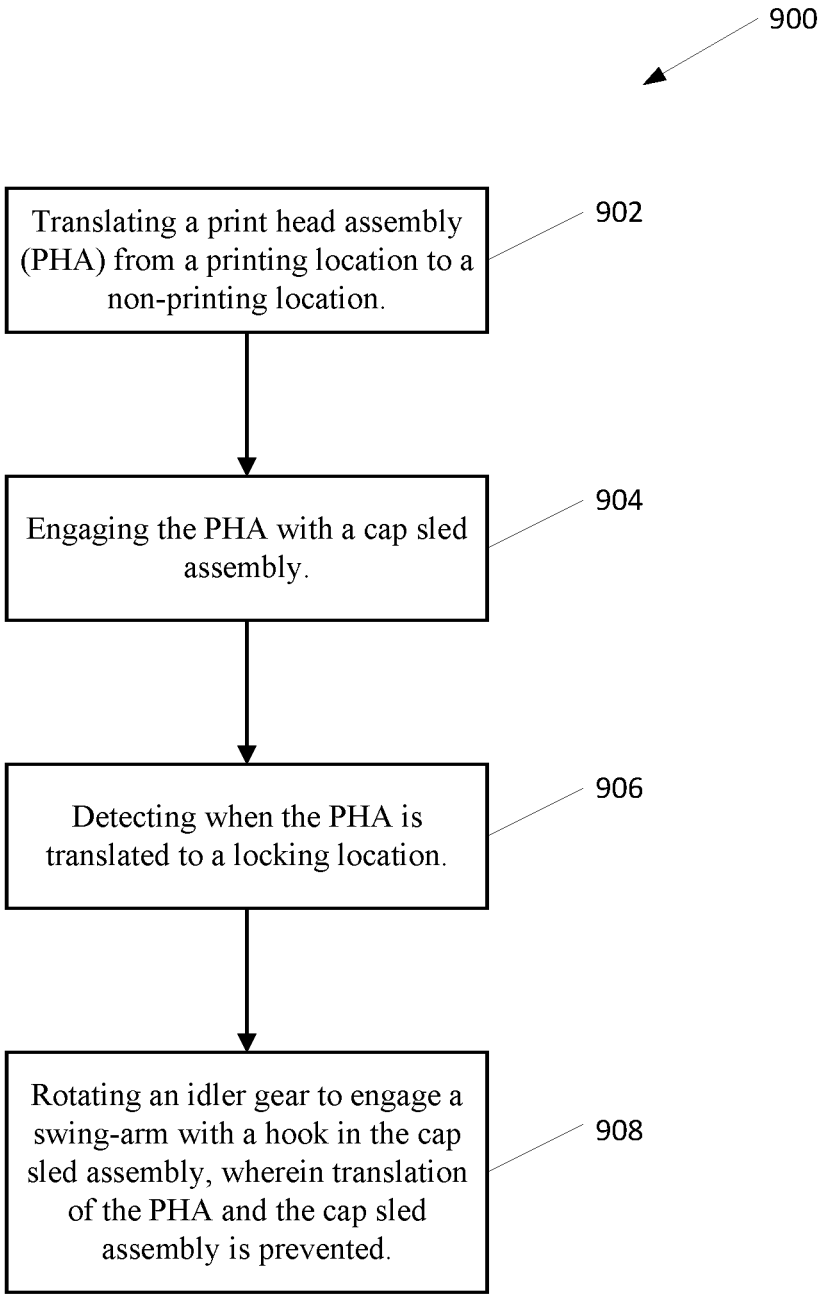
FIG. 16 is a flowchart illustrating a method for capping and locking a print head assembly.

Referring now to FIG. 16, a flowchart illustrates an example method for locking a print head in an inkjet printer. The example method 900 includes translating a print head assembly (PHA) from a printing location to a non-printing location (block 902). For example, as described above with respect to FIG. 4, a print head assembly such as PHA 101 is translated to a non-printing zone (e.g., zone 104 of FIG. 2) where it makes contact with a post (e.g., post 204) of a cap sled assembly such as cap sled assembly 105.

The example method 900 further includes engaging the PHA with a cap sled assembly (block 904). For example, as described above with respect to FIG. 5, further translating the PHA 101 toward its leftmost location in the non-printing zone 104 causes the cap sled assembly 105 to translate both horizontally with the PHA 101, and vertically to cap the nozzles of the PHA 101.

Next, example method 900 includes detecting when the PHA has been translated to a locking location (block 906). For example, as described above with respect to FIGS. 5 and 6, when the PHA 101 and the cap sled assembly 105 are fully engaged and translated to their leftmost location in the non-printing zone 104, where the swing-arm 210 is aligned with the hook 205 of the cap sled assembly 105, a detector such as, for example, a position encoder, an electrical contact or a mechanical switch may be used to report the position of the PHA 101 (corresponding to the position of the cap sled assembly 105) to a controller which controls the motor 206 (see FIG. 3) and the rotation of the idler gear 209 and the swing-arm 210.

Finally, example method 900 includes rotating an idler gear to engage a swing-arm with a hook in the cap sled assembly, so that translation of the PHA and the cap sled assembly is prevented (block 908). For example, as described above and illustrated by FIG. 8, idler gear 209 and swing-arm 210 are rotated (counter-clockwise in the view provided by FIG. 8) to engage the swing-arm 210 with the hook 205 on the cap sled assembly 105, which locks the cap sled assembly 105 and the PHA 101 in place.

Figure 17:
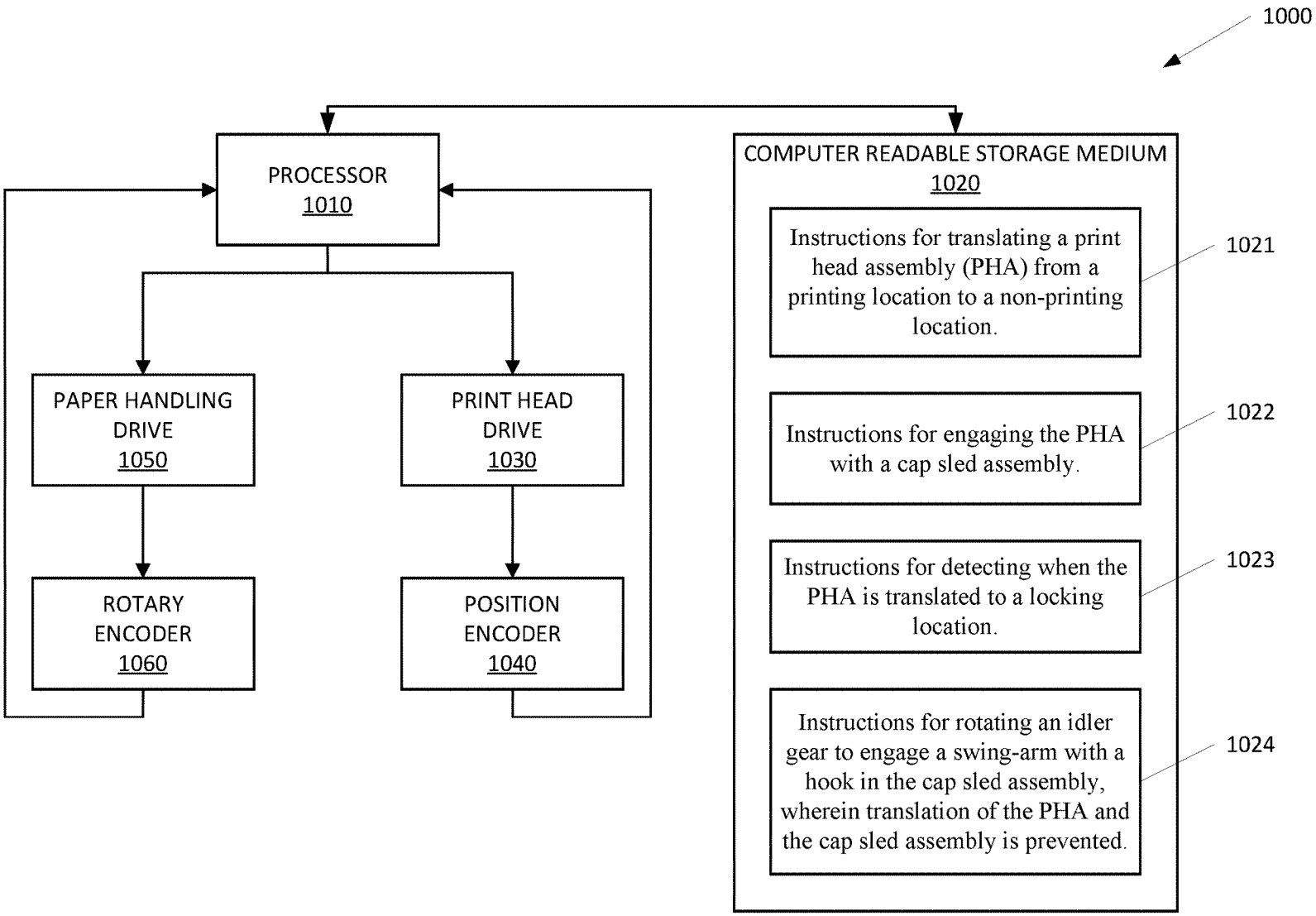
FIG. 17 illustrates a system, including a non-transitory computer-readable medium, for capping and locking a print head assembly.

Referring now to FIG. 17, a block diagram of an example system is illustrated with a non-transitory computer-readable storage medium, including instructions executable by a processor for capping and locking a print head assembly (PHA). The example system 1000 includes a processor 1010 coupled with a non-transitory computer-readable storage medium 1020, including example instructions 1021-1024 for capping and locking a PHA. In various examples, the non-transitory computer-readable storage medium 1020 may be any of a variety of storage devices including, but not limited to, a random-access memory (RAM) a dynamic RAM (DRAM), static RAM (SRAM), flash memory, read-only memory (ROM), programmable ROM (PROM), electrically erasable PROM (EEPROM), or the like. In various examples, the processor 1010 may be a general-purpose processor, a controller, special purpose logic, or the like.

Example system 1000 may also include a print head drive system 1030 that controls the translation of the PHA in both printing and non-printing (e.g., storage) locations, and a position encoder 1040 to detect the position of the PHA and to report the position of the PHA to the processor 1010 in a feedback control loop. Example system 1000 may also include a paper handling and PHA locking system 1050 for handling paper and for locking the PHA as described above. For example, with respect to FIGS. 2 and 10, the paper handling and PHA locking system 1050 may include a motor (such as motor 206), a belt-driven gear (such as driven gear 208), an idler gear (such as idler gear 209), and a swing-arm with a locking arm (such as swing-arm 210 with locking arm 306) to lock the PHA in its non-printing location. The example system 1000 may also include a rotary encoder (such as rotary encoder 215 in FIG. 8) to detect the rotation of gears in the paper-handling and PHA locking system 1050, and to report the angular positions to the processor 1010 in a feedback control loop.

The example instructions include instructions for translating a print head assembly (PHA) from a printing location to a non-printing location (instruction 1021). For example, as described above with respect to FIG. 4, a print head assembly such as PHA 101 is translated to a non-printing zone (e.g., zone 104 of FIG. 2) where it makes contact with a post (e.g., post 204) of a cap sled assembly such as cap sled assembly 105.

The example instructions further include instructions for engaging the PHA with a cap sled assembly (instruction 1022). For example, as described above with respect to FIG. 5, further translating the PHA 101 toward its leftmost location in the non-printing zone 104 causes the cap sled assembly 105 to translate both horizontally with the PHA 101, and vertically to cap the nozzles of the PHA 101.

The example instructions also include instructions for detecting when the PHA is translated to a locking location (instruction 1023). For example, as described above with respect to FIGS. 5 and 6, when the PHA 101 and the cap sled assembly 105 are fully engaged and translated to their leftmost location in the non-printing zone 104, where the swing-arm 210 is aligned with the hook 205 of the cap sled assembly 105, a detector such as, for example, a position encoder, an electrical contact or a mechanical switch may be used to report the position of the PHA 101 (corresponding to the position of the cap sled assembly 105) to a controller which controls the motor 206 (see FIG. 3) and the rotation of the idler gear 209 and the swing-arm 210.

Finally, the example instructions include instructions for rotating an idler gear to engage a swing-arm with a hook in the cap sled assembly, wherein translation of the PHA and the cap sled assembly is prevented (instruction 1024). For example, as described above and illustrated by FIG. 8, idler gear 209 and swing-arm 210 are rotated (counter-clockwise in the view provided by FIG. 8) to engage the swing-arm 210 with the hook 205 on the cap sled assembly 105, which locks the cap sled assembly 105 and the PHA 101 in place.

The foregoing description has presented examples of apparatus, methods and systems for capping and locking a print head assembly in an inkjet printer.

In one example, a disclosed apparatus includes an idler gear including a gear hub, a swing-arm rotationally engaged with the gear hub, and a spring circumferentially engaged with the gear hub and the swing-arm to apply a radial clamping force between the swing-arm and the gear hub, wherein torque is frictionally coupled from the gear hub to the swing-arm to lock a capped print head assembly (PHA) in a non-printing location.

In one example, the swing-arm includes an arced segment, the arced segment comprising an inner circular arc segment concentric with an outer diameter of the gear hub and an outer arc segment concentric with an inner diameter of the spring and eccentric with the outer diameter of the gear hub.

In one example, the capped PHA includes a cap sled assembly engaged with the PHA when the PHA is translated to the non-printing location, wherein the cap sled assembly is interlocked with the PHA to prevent relative horizontal movement between the PHA and the cap sled assembly, and wherein the cap sled assembly is translated vertically to cap nozzles of the PHA.

In one example, the cap sled assembly is operative to provide a controlled pressure environment for the nozzles of the PHA by capping the nozzles with elastomeric caps that provide a controlled compressive seal based on the characteristics of the elastomeric materials and the force applied by the cap sled assembly. In one example of a controlled environment, pressure is maintained proximate to ambient pressure (e.g., via venting). In one example, the swing-arm also includes a locking arm to engage a hook on the cap sled assembly when the PHA is translated to the non-printing location, wherein the engagement of the hook prevents translation of the PHA and the cap sled assembly.

In one example, the apparatus also includes a linear position encoder to detect when the PHA is translated to the non-printing location.

In one example, the apparatus also includes a hinge supported by a pin in a support bracket around which it rotates, where the pin also supports an idler gear with the same center of rotation as the hinge, and where the hinge includes facets to engage matching facets of the swing-arm to limit rotation of the locking arm independent of rotation of the idler gear.

In one example, a disclosed method for capping and locking a print head assembly (PHA) includes translating a print head assembly (PHA) from a printing location to a non-printing location, engaging the PHA with a cap sled assembly, detecting when the PHA is translated to a locking location, and rotating an idler gear to engage a swing-arm with a hook in the cap sled assembly, wherein translation of the PHA and the cap sled assembly is prevented.

In one example, where the swing-arm is rotationally engaged with a gear hub of the idler gear, the disclosed method includes applying a radial clamping force between the swing-arm and the gear hub, and frictionally coupling torque from the gear hub to the swing-arm.

In one example, the swing-arm includes facets to interfere with corresponding facets of a hinge connected to the idler gear, where the method further includes limiting the rotation of the swing-arm independent of rotation of the idler gear.

In one example, a disclosed system for capping and locking a print head assembly (PHA) includes a non-transitory computer-readable storage medium encoded with instructions executable by a processor of a computing system, the computer-readable storage medium including instructions to translate a print head assembly (PHA) to a non-printing location, instructions to engage the PHA with a cap sled assembly in the non-printing location, instructions to detect the engagement of the PHA with the cap sled assembly, and instructions to control a motor-driven gear chain to lock the PHA and cap sled assembly at the non-printing location.

Thus, in accordance with various examples provided herein, print head capping and locking may be used to provide a controlled environment for a print head assembly when the printer is in a non-printing mode and for extended periods of non-operation.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. An apparatus, comprising:

a gear comprising a gear hub;

a swing-arm rotationally engaged with the gear hub; and a compressive member circumferentially engaged with the gear hub and the swing-arm to apply a radial clamping force between the swing-arm and the gear hub, wherein torque is frictionally coupled from the gear hub to the swing-arm to lock a capped print head assembly (PHA) in a non-printing location.

2. The apparatus of claim 1, wherein the swing-arm comprises an arced segment, the arced segment comprising an inner circular arc segment concentric with an outer diameter of the gear hub and an outer arc segment concentric with an inner diameter of the compressive member and eccentric with the outer diameter of the gear hub.

3. The apparatus of claim 1, the capped PHA comprising a cap sled assembly engaged with the PHA when the PHA is translated to the non-printing location, wherein the cap sled assembly is interlocked with the PHA to prevent relative horizontal movement between the PHA and the cap sled assembly, and wherein the cap sled assembly is translated vertically to cap nozzles of the PHA.

4. The apparatus of claim 3, wherein the cap sled assembly is operative to provide a controlled pressure environment for the nozzles of the PHA.

5. The apparatus of claim 3, wherein the swing-arm further comprises a locking arm to engage a hook on the cap sled assembly when the PHA is translated to the non-printing location, wherein the engagement of the hook prevents translation off the PHA and the cap sled assembly.

6. The apparatus of claim 5, further comprising a hinge connected to the gear, the hinge comprising facets to engage matching facets of the swing-arm to limit rotation of the locking arm independent of rotation of the gear.

7. The apparatus of claim 5, further comprising a processor to sequence the engagement of the PHA with the cap sled assembly and the engagement of the locking arm with the hook.

8. The apparatus of claim 3, further comprising a linear position encoder to detect when the PHA is translated to the non-printing location.

9. An apparatus, comprising:

a print head assembly (PHA) translatable from a printing location to a non-printing location;

a cap sled assembly engaged with the PHA, the cap sled assembly comprising a cap to seal the PHA;

a swing-arm rotationally engaged with a gear hub of a gear;

a coil spring to apply a radial clamping force between the swing-arm and the gear hub, wherein torque is frictionally coupled from the gear hub to the swing-arm, wherein the swing-arm is operable by the gear to engage a hook in the cap sled assembly, wherein translation of the PHA and the cap sled assembly is prevented.

10. The apparatus of claim 9, wherein the cap sled assembly is operative to provide a controlled pressure environment for the PHA.

11. The apparatus of claim 9, wherein the swing-arm further comprises a locking arm to engage a hook on the cap sled assembly when the PHA is translated to the non-printing location, wherein the engagement of the hook prevents translation off the PHA and the cap sled assembly.

12. The apparatus of claim 11, wherein the swing-arm comprises facets to interfere with corresponding facets of a hinge connected to the gear, the corresponding facets to limit the rotation of the swing-arm independent of rotation of the gear.

13. A non-transitory computer-readable storage medium encoded with instructions executable by a processor of a computing system, the computer-readable storage medium comprising instructions to:

translate a print head assembly (PHA) to a non-printing location;

engage the PHA with a cap sled assembly in the non-printing location;

detect the engagement of the PHA with the cap sled assembly; and control a motor-driven gear chain to lock the PHA and cap sled assembly at the non-printing location, wherein the motor-driven gear chain comprises a motor-driven gear, an idler gear coupled with the motor-driven gear, and a swing-arm frictionally coupled with a hub of the idler gear to engage a hook in the cap sled assembly.

14. The non-transitory computer-readable storage medium of claim 13, further comprising instructions to unlock the PHA and cap sled assembly by disengaging the swing-arm from the hook.

* * * * *